US006817635B2

(12) United States Patent
Maier et al.

(10) Patent No.: US 6,817,635 B2
(45) Date of Patent: Nov. 16, 2004

(54) FUEL INJECTOR AND CORRESPONDING PRODUCTION METHOD

(75) Inventors: Martin Maier, Moeglingen (DE); Guenther Hohl, Stuttgart (DE); Guenter Dantes, Eberdingen (DE); Detlef Nowak, Untergruppenbach (DE)

(73) Assignee: Robert Bosch GmbH, Stuttgart (DE)

( * ) Notice: Subject to any disclaimer, the term of this patent is extended or adjusted under 35 U.S.C. 154(b) by 22 days.

(21) Appl. No.: 10/182,410

(22) PCT Filed: Nov. 29, 2001

(86) PCT No.: PCT/DE01/04463

§ 371 (c)(1),
(2), (4) Date: Oct. 29, 2002

(87) PCT Pub. No.: WO02/44547

PCT Pub. Date: Jun. 6, 2002

(65) Prior Publication Data

US 2003/0132321 A1 Jul. 17, 2003

(30) Foreign Application Priority Data

Nov. 29, 2000 (DE) ..... 100 59 263

(51) Int. Cl.[7] ..... B05B 1/30

(52) U.S. Cl. ..... 289/585.1; 239/585.3; 239/585.5; 239/900

(58) Field of Search ..... 239/88–91, 533.2, 239/533.3, 533.9, 533.11, 584, 585.1, 585.3, 585.4, 585.5, 900; 123/445; 29/890.143; 251/129.15, 129.21

(56) References Cited

U.S. PATENT DOCUMENTS

| | | | | |
|---|---|---|---|---|
| 3,118,611 A | | 1/1964 | Berlyn | 239/533 |
| 4,778,107 A | | 10/1988 | Hieda et al. | 239/1 |
| 5,127,156 A | | 7/1992 | Kanamaru et al. | 29/890.143 |
| 5,330,100 A | * | 7/1994 | Malinowski | 239/102.2 |
| 5,467,924 A | | 11/1995 | Buescher et al. | 239/88 |
| 5,613,640 A | | 3/1997 | Furuya et al. | 239/585.5 |
| 5,692,723 A | * | 12/1997 | Baxter et al. | 251/129.21 |
| 5,921,473 A | * | 7/1999 | Romann | 239/533.2 |
| 6,168,135 B1 | * | 1/2001 | Fochtman | 251/129.15 |
| 6,257,496 B1 | * | 7/2001 | Wyant | 239/5 |

FOREIGN PATENT DOCUMENTS

| | | |
|---|---|---|
| DE | 631 135 | 6/1936 |
| DE | 196 25 059 | 1/1998 |
| DE | 197 36 682 | 2/1999 |
| EP | 1 041 274 | 10/2000 |
| GB | 324 655 | 1/1930 |
| JP | 11 320 206 | 11/1999 |
| NL | 76 067 | 5/1954 |

* cited by examiner

*Primary Examiner*—Thomas Denion
*Assistant Examiner*—Kyle M. Riddle
(74) *Attorney, Agent, or Firm*—Kenyon & Kenyon

(57) ABSTRACT

A fuel injector for fuel injection systems of internal combustion engines and a method of manufacturing same are described. The fuel injector includes a valve seat body into which a valve seat face is introduced, which cooperates with a valve closing body to form a sealing seat, and a nozzle body to which the valve seat body is fixedly connected. The valve seat body is insertable into the interior of the nozzle body and on its downstream side it has a partially spherical outside geometry, which rests on a bearing surface of a seat body recess in the nozzle body. Valve seat body is mounted so it can rotate relative to the nozzle body on the bearing surface until its position is finally secured, and it may be aligned by a centering mandrel.

20 Claims, 3 Drawing Sheets

FUEL INJECTOR AND CORRESPONDING PRODUCTION METHOD

FIELD OF THE INVENTION

The present invention relates to a fuel injector and a method of producing same.

BACKGROUND INFORMATION

German Published Patent Application No. 197 36 682, for example, describes fuel injectors having a valve seat body which is inserted on the downstream end of the fuel injector into a nozzle body of the fuel injector from the downstream side. In the valve seat body they have a valve seat face which cooperates with a valve closing body to form a sealing seat. A weld is used for fixation. A swirl-producing module is situated upstream from the valve seat body and is positioned on the upstream side of the valve seat body with the help of a spring. The swirl-producing module is composed of a guide disk and a swirl disk which is situated between the guide disk and the valve seat body.

The weld between the valve seat body and the nozzle body must provide a seal while also resisting the force exerted by the fuel pressure and the spring force pressing the valve closing body onto the valve seat face. The valve seat body is pressed into the nozzle body and then welded. Because of the compression connection, which forms the basis for a welding operation of a reproducibly high quality, it is impossible to correct the position of the parts relative to one another. However, the quality of the sealing seat depends on the relative position of the central axes. Therefore, these parts are turned in a complex machining operation to ensure the required high precision.

To compensate for tolerances in position of the valve needle, the guide disk is mounted on the swirl disk so that it is displaceable radially. Therefore, a slight valve needle offset may be compensated.

German Published Patent Application No. 196 25 059 also describes a fuel injector with which the conditioning of fuel to be spray-discharged and the sealing seat are located together in a valve seat body. The valve seat body has a recess to guide the valve needle. Upstream from the valve seat face, fuel channels are introduced into the valve seat body through which fuel is spray-discharged in individual jets through a large opening. The valve seat body itself is machined in a turning operation and is pressed into the nozzle body from the downstream direction and then welded.

One disadvantage of the known fuel injectors is the lack of a possibility to compensate for tolerances in parts which occur due to positioning of the valve seat body. In particular, for the fuel injector known from German Published Patent Application No. 196 25 059, the position of the guide bore relative to the valve seat is extremely important. To achieve good guidance of the valve needle, the clearance is kept as small as possible. At the same time, however, compensation of tolerances is possible only through this clearance. Increasing the size of the clearance might ultimately allow vibration of the valve needle, which is undesirable. On the other hand, if the clearance is too small, the valve needle is subject to mechanical wear, grinding on the guide bore with each opening and closing operation of the fuel injector.

Both fuel injectors have the disadvantage that it is impossible to compensate for an angular misalignment in the valve needle. With the narrow play described here between the valve needle and the guide bore, this unavoidably results in tilting of the valve needle in the guide bore.

Another disadvantage is the requirement of the weld itself, which must have a high mechanical strength but at the same time also has a sealing function. This makes the process management, and in particular its monitoring, much more difficult.

SUMMARY OF THE INVENTION

The fuel injector according to the present invention has the advantage over the related art that the position of the valve seat is variable. In assembly of the fuel injector according to the method of the present invention, an accurate alignment is achieved. The valve seat body is held in this position and then welded there.

Another advantage is achieved due to the insertion of the valve seat body from the inside. The forces acting on the valve seat body are absorbed by the nozzle body. The weld is not under mechanical stress. The process management is thus greatly simplified, as is the inspection of the joint. A leakage test may be performed on the fuel injector by simply pressing on it.

Welding the swirl disk to the valve seat body reduces the positional tolerance in an advantageous manner. The position may be defined precisely by a centering mandrel. By joining the two parts, the swirl disk and the guide disk together with the valve seat body may be handled as one module. Likewise there is the possibility of preassembly, so that any valve seat module rejects is not picked as late as at the fuel injector production line.

In addition, use of a ball as a valve seat body is advantageous. The swirl-processing recesses are introduced into the ball. Use of a ball bearing balls, for example, reduces costs because they are inexpensive and are available in large numbers and in a uniform quality. Handling of the balls is simple because they need not be oriented a certain way when supplied for machining.

DETAILED DESCRIPTION

Figure 1:
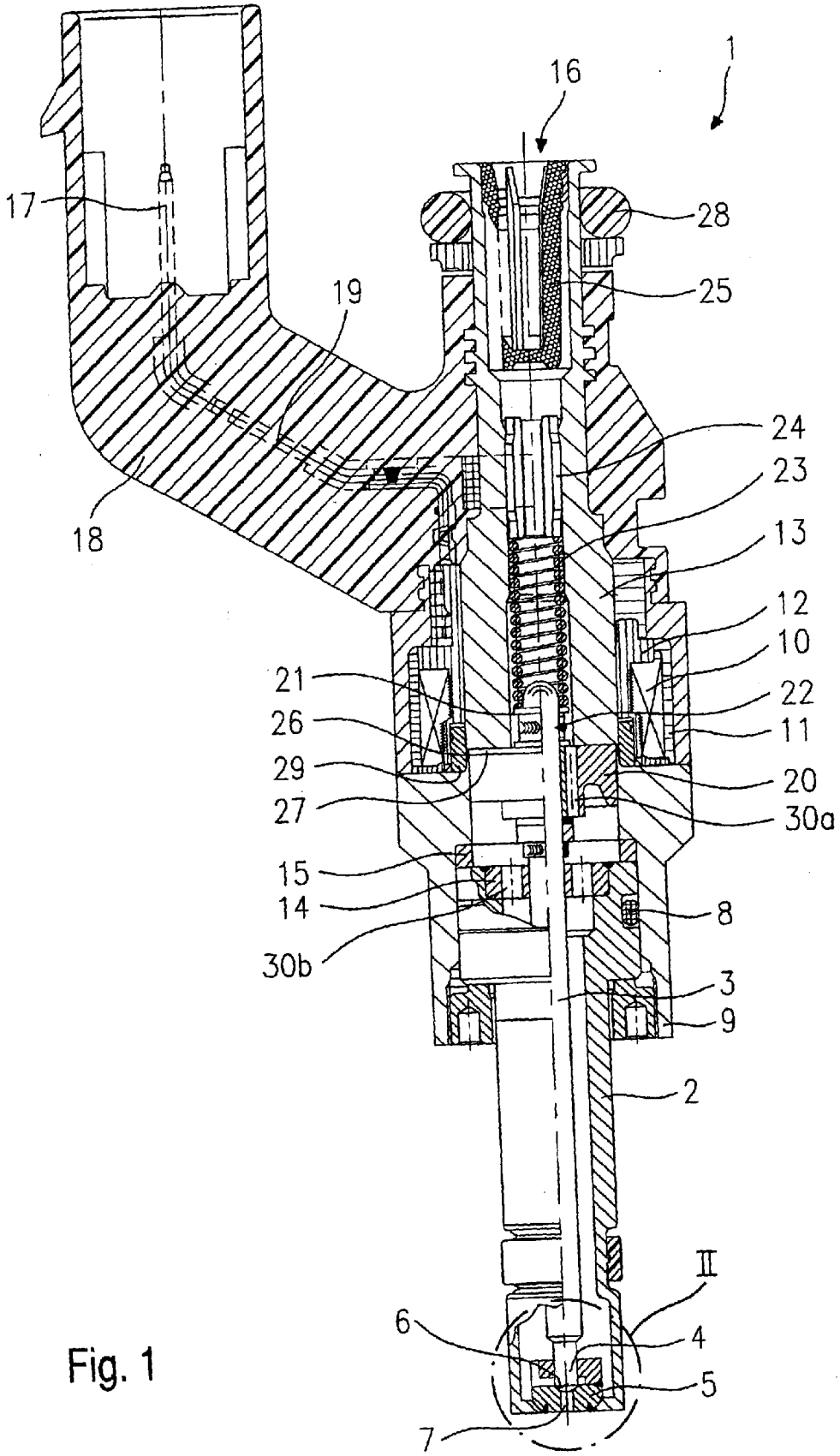
FIG. 1 shows a schematic partial section through an embodiment of a fuel injector according to the present invention.

Before describing exemplary embodiments of fuel injectors 1 according to the present invention in greater detail on the basis of FIGS. 2 through 5, fuel injector 1 will first be explained briefly with regard to its components on the basis of an overall diagram as illustrated in FIG. 1 to give a better understanding of the present invention.

Fuel injector 1 is implemented in the form of a fuel injector 1 for fuel injector systems of internal combustion engines having compression of a fuel-air mixture with spark ignition. Fuel injector 1 is suitable in particular for direction injection of fuel into a combustion chamber (not shown) of an internal combustion engine.

Fuel injector 1 includes a nozzle body 2 in which a valve needle 3 is situated. Valve needle 3 is mechanically linked to a valve closing body 4 which cooperates with a valve seat face 6 situated on a valve seat body 5 to form a sealing seat. Fuel injector 1 in this exemplary embodiment is an electromagnetically operated fuel injector 1 having at least one spray-discharge orifice 7. Nozzle body 2 is sealed by a gasket 8 with respect to the stationary pole of a solenoid 10. Solenoid 10 is encapsulated in a coil housing 11 and is wound onto a bobbin 12 which contacts an internal pole 13 of solenoid 10. Internal pole 13 and external pole 9 are separated by a gap 26 and supported on a connecting piece 29. Solenoid 10 is energized by an electric current suppliable over a line 19 via an electric plug-in contact 17. Plug-in contact 17 is encapsulated in a plastic sheathing 18 which may be extruded onto internal pole 13.

Valve needle 3 is guided in a valve needle guide 14 designed in the form of a disk. It is paired with an adjusting disk 15 which is used to adjust the valve needle lift. An armature 20 is situated on the upstream side of adjusting disk 15. It is non-positively connected via a flange 21 to valve needle 3, which is connected to flange 21 by a weld 22. A restoring spring 23 is supported on flange 21; in the present design of fuel injector 1, the spring is prestressed by a sleeve 24 pressed into internal pole 13.

Fuel channels 30*a*, 30*b* run in valve needle guide 14 and in armature 20. A filter element 25 is situated in a central fuel feed 16. Fuel injector 1 is sealed by a gasket 28 against a fuel line (not shown).

In the idle state of fuel injector 1, armature 20 is acted upon by restoring spring 23 against its direction of lift via flange 21 on valve needle 3, so that valve closing body 4 is held in sealing contact on valve seat face 6. When solenoid 10 is energized, it creates a magnetic field which moves armature 20 in the direction of lift against the spring force of restoring spring 23, the lift being determined by a working clearance 27 provided between internal pole 13 and armature 20 in the rest position. Armature 20 also entrains flange 21 which is welded to valve needle 2 and thus also entrains valve needle 3 in the direction of lift. Valve closing body 4, which is mechanically linked to valve needle 3, is lifted up from valve seat face 6, and fuel flows through swirl channels 36 to spray-discharge orifice 7 and is spray-discharged.

When the coil current is switched off, after the magnetic field has decayed adequately, armature 20 drops back from internal pole 13 onto flange 21 due to the pressure of restoring spring 23 so that valve needle 3 is moved against the direction of lift. Therefore, valve closing body 4 comes to rest on valve seat face 6 and fuel injector 1 is closed.

Figure 2:
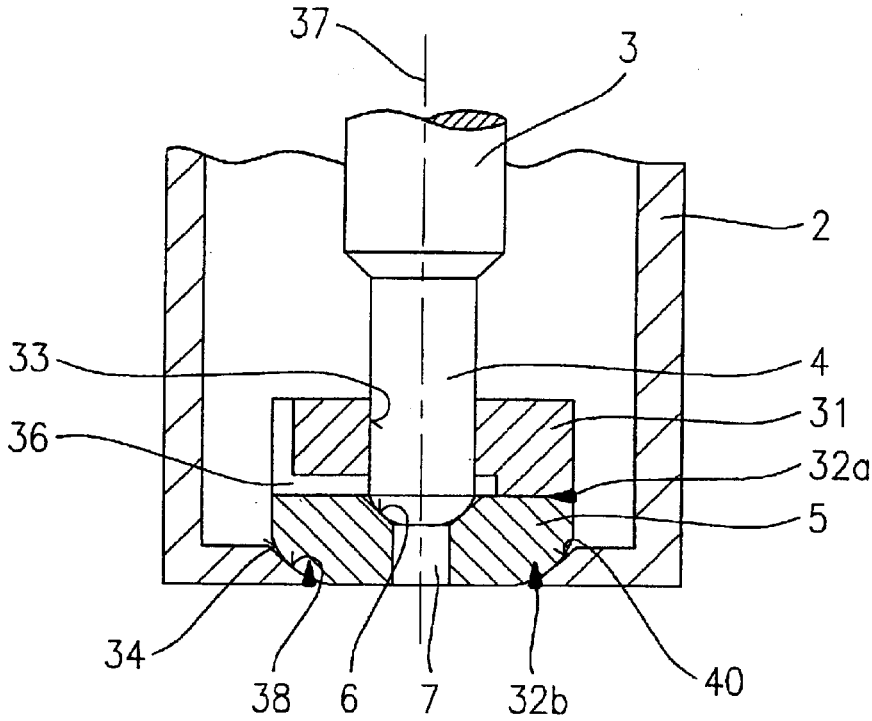
FIG. 2 shows a schematic partial section in detail II of FIG. 1 through a first embodiment of a fuel injector according to the present invention.

FIG. 2 shows in detail II from FIG. 1 a detailed partial section through a first exemplary embodiment of a fuel injector 1 according to the present invention. A seat body recess 38 whose radial dimension is smaller than the radial dimension of valve seat body 5 is created in nozzle body 2 on its downstream end. Seat body recess 38 tapers in the shape of a truncated cone toward the downstream side of nozzle body 2. Between the inside and outside of nozzle body, seat body recess 38 thus forms a bearing surface 40. Valve seat body 5 is inserted from the inside of nozzle body 2 so that it rests on bearing surface 40 of seat body recess 38.

On its downstream side, valve seat body 5 has a partially spherical outer contour 34 at least in the area of seat body recess 38. The center of partially spherical outer contour 34 sits on center axis 37 of fuel injector 1. A valve seat face 6 is introduced on the upstream side of valve seat body 5. Downstream, a spray-discharge orifice 7 is connected to valve seat face 6.

Valve closing body 4 is also designed with a partially spherical shape on its downstream end, the center of the spherical geometry of valve closing body 4 preferably being identical to the center of the partially spherical outer contour 34. Upstream from the sealing seat, valve closing body 4 is guided so that it is easily movable in the axial direction.

To guide valve closing body 4 a guide recess 33 is introduced into a swirl disk 31 situated upstream from valve seat body 5. The gap formed between guide recess 33 and valve closing body 4 is designed to be hydraulically sealing. Fuel to be injected therefore goes exclusively through swirl channels 36 to the sealing seat. Swirl channels 36 may be produced, for example, as grooves in swirl disk 31, which are closed by the upstream side of valve seat body 5 to form swirl channels 36. Swirl channels 36 open tangentially, for example, into valve seat face 6, so that a circumferential component is imparted to the fuel flow when fuel injector 1 is opened.

Swirl disk 31 and valve seat body 5 are preferably joined by a weld 32. These two components are assembled before the actual assembly of fuel injector 1. Valve seat body 5 and swirl disk 31 are manufactured in two separate manufacturing operations. Then the two parts are joined and the two central axes are brought into alignment with the help of a centering mandrel, for example. In this position, swirl disk 31 is joined to valve seat body 5 by a weld 32. As an alternative to welding, other permanently stable fastening techniques such as hard soldering, for example, may also be used.

The module composed of swirl disk 31 and valve seat body 5 is then inserted into nozzle body 2 with partially spherical outer contour 34 head first in nozzle body 2. Positioning is again accomplished by using a centering mandrel, for example. After alignment of the position of the module relative to nozzle body 2, the position is secured, preferably again using a welding method. Instead of the centering mandrel, it is also possible to use valve needle 3 and valve closing body 4. In particular, alignment of valve seat body 5 and swirl disk 31 with respect to nozzle body 2 is thus capable of correcting unavoidable tolerances in parts. Furthermore, no additional operation need be planned into the manufacture of fuel injector 1 if valve needle 3 and valve closing body 4 are used for centering.

At the time of assembly, valve seat body 5 may be rotated about any desired axis which runs through the center of its partially spherical outside contour 34. Fuel injector 1 may be completely assembled, for example, and then in a last operation weld 32*b* is produced by using a laser, for example. Due to the truncated conical shape of the bearing surface of seat body recess 38, valve seat body 5 is held in nozzle body 2 not only during the manufacturing process. Forces acting on valve seat body 5 in the axial direction are also transmitted through the bearing surface to the nozzle body, so that weld 32*b* has only a sealing function and the function of securing the position.

Figure 3:
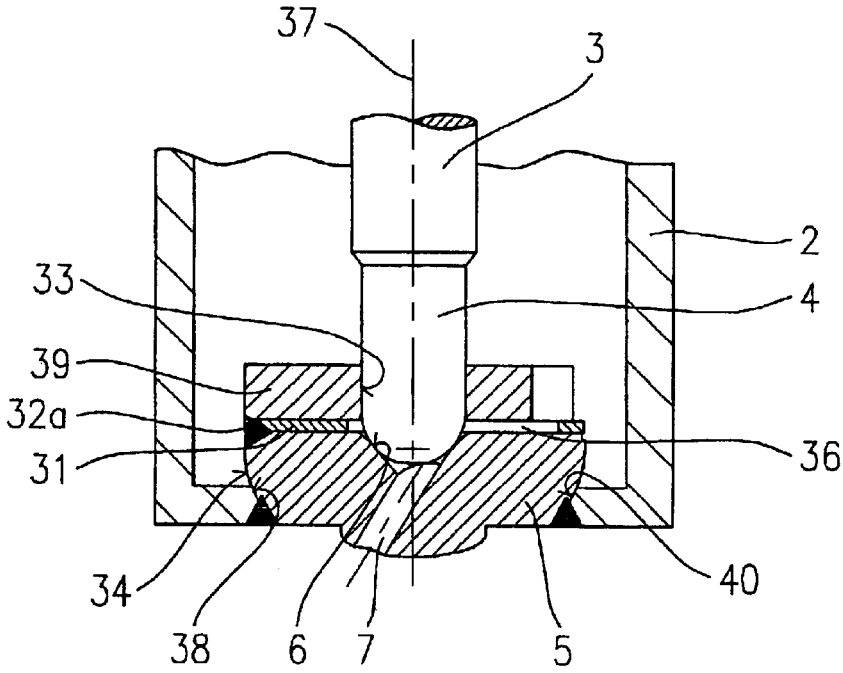
FIG. 3 shows a schematic partial sectional view in detail II of FIG. 1 through a second embodiment of a fuel injector according to the present invention.

A second exemplary embodiment of a fuel injector 1 according to the present invention is illustrated in FIG. 3. In contrast with the first exemplary embodiment, seat body recess 38 is introduced into nozzle body 2 in such a way that the bearing surface of seat body recess 38 formed between the inside and outside of nozzle body 2 has a partially spherical shape. The radius of this spherical geometry corresponds to partially spherical outside contour 34 of valve seat body 5.

As in the first exemplary embodiment, a complete module is inserted into the nozzle body. In the present example, it is a preassembled composite of guide disk 39, into which a guide recess 33 has been introduced, and a swirl disk 31 having swirl channels 36, for example, in the form of punched-out sections, which are closed by guide disk 39 on the upstream side and valve seat body 5 on the downstream side. Before insertion of the module, guide disk 39 and swirl disk 31 are joined to valve seat body 5. This may be accomplished by welding, for example, according to the discussion of FIG. 3.

Figure 4:
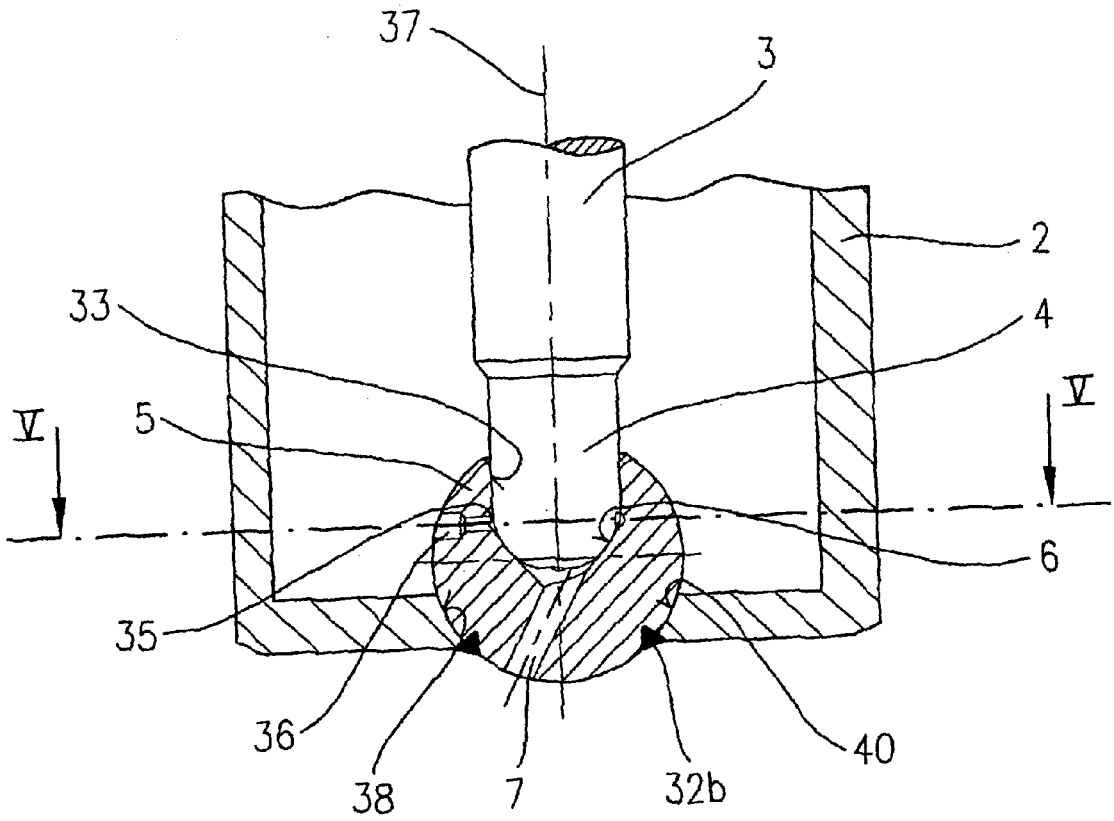
FIG. 4 shows a schematic partial sectional view in detail II of FIG. 1 through a third embodiment of a fuel injector according to the present invention.

FIG. 4 shows a third exemplary embodiment of a fuel injector according to the present invention in which the production of swirl and the guidance of valve closing body 4 are integrated into valve seat body 5.

As in the preceding exemplary embodiment, a seat body recess 38 having a partially spherical geometry is introduced into nozzle body 2. It corresponds to a ball, which is used as valve seat body 5. A ball bearing is preferably used as valve closing body 5. A guide recess 33 is introduced into valve seat body 5 for guidance of valve closing body 4. Boreholes, for example, may be introduced as swirl channels 36, opening with a tangential component upstream from valve seat face 6 into an annular channel 35. Valve seat body 5 is inserted into nozzle body 2 by analogy with the process steps explained with regard to FIG. 2.

Figure 5:
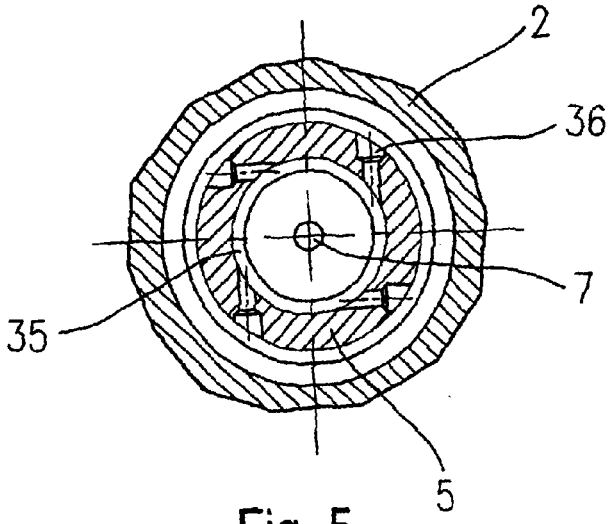
FIG. 5 shows a section through the third embodiment along line V—V in FIG. 4.

FIG. 5 shows a section along line V—V through valve seat body 5 and nozzle body 2 of the third exemplary embodiment. Swirl channels 36 open into annular channel 35. When fuel injector 1 is opened, the fuel flow which is established through four swirl channels 36, for example, may become uniform in annular channel 35 before the fuel is spray-discharged through spray-discharge orifice 7. The fuel which is spray-discharged may have a direction deviating from central axis 37 of fuel injector 1. Spray-discharge orifice 7 introduced into valve seat body 5 forms an angle with central axis 37 of fuel injector 1 for deflection of fuel accordingly.

What is claimed is:

1. A fuel injector for a fuel injection system of an internal combustion engine, comprising:

a valve seat face;

a valve closing body;

a valve seat body into which the valve seat face is introduced, the valve seat face cooperating with the valve closing body to form a sealing seat; and a nozzle body to which the valve seat body is fixedly connected;

wherein the valve seat body is insertable into an interior of the nozzle body and has a partially spherical outside geometry that rests on a bearing surface of a seat body recess in the nozzle body; and wherein before a fixed connection to the nozzle body has been established, the valve seat body is rotatable about any desired axis through a center of the partially spherical outside geometry on the bearing surface of the seat body recess.

2. The fuel injector according to claim 1, wherein:

the seat body recess is formed in the nozzle body having the partially spherical outside geometry as the bearing surface.

3. The fuel injector according to claim 2, wherein:

in an idle state of the fuel injector, a center of the bearing surface of the seat body recess is identical to a center of the valve closing body.

4. The fuel injector according to claim 1, wherein:

the seat body recess forms a lateral face of a truncated cone tapering in a downstream direction as the bearing surface.

5. The fuel injector according to claim 1, wherein:

the valve seat body is joined to the nozzle body by welding to secure a position thereof.

6. The fuel injector according to claim 1, wherein:

the valve seat body is joined to the nozzle body by soldering to secure a position thereof.

7. The fuel injector according to claim 1, further comprising:

a swirl disk welded to the valve seat body to form a module that is jointly insertable into the nozzle body.

8. A fuel injector for a fuel injection system of an internal combustion engine, comprising:

a valve seat face;

a valve closing body;

a valve seat body into which the valve seat face is introduced, the valve seat face cooperating with the valve closing body to form a sealing seat; and a nozzle body to which the valve seat body is fixedly connected;

wherein the valve seat body is insertable into an interior of the nozzle body and has a partially spherical outside geometry that rests on a bearing surface of a seat body recess in the nozzle body; and wherein the valve seat body is a ball.

9. The fuel injector according to claim 8, wherein:

the seat body recess is formed in the nozzle body having the partially spherical outside geometry as the bearing surface.

10. The fuel injector according to claim 9, wherein:

in an idle state of the fuel injector, a center of the bearing surface of the seat body recess is identical to a center of the valve closing body.

11. The fuel injector according to claim 8, wherein:

the seat body recess forms a lateral face of a truncated cone tapering in a downstream direction as the bearing surface.

12. The fuel injector according to claim 8, wherein:

the valve seat body is joined to the nozzle body by welding to secure a position thereof.

13. The fuel injector according to claim 8, wherein:

the valve seat body is joined to the nozzle body by soldering to secure a position thereof.

14. The fuel injector according to claim 8, further comprising:

a swirl disk welded to the valve seat body to form a module that is jointly insertable into the nozzle body.

15. A method of assembly of a fuel injector that includes a valve seat face, a valve closing body, a valve seat body into which the valve seat face is introduced, the valve seat face cooperating with the valve closing body to form a sealing seat, and a nozzle body to which the valve seat body is fixedly connected, the valve seat body being insertable into an interior of the nozzle body and having a partially spherical outside geometry that rests on a bearing surface of a seat body recess, the method comprising:

inserting the valve seat body into the nozzle body;

introducing a centering mandrel into a guide recess of the valve seat body; and securing a position of the valve seat body in the nozzle body.

16. The method according to claim 15, wherein:

the valve closing body serves as the centering mandrel.

17. The method according to claim 15, further comprising:

welding the valve seat body to the nozzle body.

18. The method according to claim 15, further comprising:

soldering the valve seat body to the nozzle body.

19. The method according to claim 15, further comprising:

welding the valve seat body to a swirl disk before insertion into the nozzle body.

20. The method according to claim 15, further comprising:

welding the valve seat body to a guide disk; and after welding, inserting the valve seat body into the nozzle body.

* * * * *